US005393063A

United States Patent [19]

Ichimaru

[11] Patent Number: 5,393,063

[45] Date of Patent: Feb. 28, 1995

[54] CUBE PUZZLE

[75] Inventor: Tomonobu Ichimaru, Yokohama, Japan

[73] Assignee: Kabushiki Kaisha Kitaharaseisakusho, Kanagawa, Japan

[21] Appl. No.: 220,891

[22] Filed: Mar. 31, 1994

[30] Foreign Application Priority Data

Apr. 2, 1993 [JP] Japan ..... 5-022132[U]

[51] Int. Cl.[6] ..... A63F 9/12

[52] U.S. Cl. ..... 273/160

[58] Field of Search ..... 273/156, 157, 160, 153 R

[56] References Cited

U.S. PATENT DOCUMENTS

| | | | |
|---|---|---|---|
| 332,256 | 12/1885 | Keeler | 273/157 R X |
| 1,132,244 | 3/1915 | Degenhardt | 273/157 R |
| 1,264,944 | 5/1918 | Lancaster | 273/157 R |
| 4,662,638 | 5/1987 | Vachek | 273/160 |
| 4,699,602 | 10/1987 | Giorgi | 273/157 R X |
| 4,784,392 | 11/1988 | Johnson et al. | 273/160 |
| 4,844,466 | 7/1989 | Johnson et al. | 273/157 R |

FOREIGN PATENT DOCUMENTS

| | | |
|---|---|---|
| 57-66787 | 10/1982 | Japan . |
| 57-142593 | 3/1988 | Japan . |
| 58-1488 | 6/1988 | Japan . |
| 56-68580 | 10/1988 | Japan . |
| 63-158386 | 10/1988 | Japan . |
| 1-104288 | 4/1989 | Japan . |

*Primary Examiner*—William H. Grieb

*Attorney, Agent, or Firm*—Wenderoth, Lind & Ponack

[57] ABSTRACT

A cube puzzle comprises a large number of large different cube blocks and a small number of small different cube blocks for assembling three dimensional configurations and plane desired patterns, and also for assembling an overall cube when assembled in a final configuration. The assembled cube block is expressed by a formula of $n^3=6^3$.

5 Claims, 17 Drawing Sheets

CUBE PUZZLE

BACKGROUND OF INVENTION

1. Field of the Invention

This invention relates to a three dimensional cube puzzle and a plane pattern puzzle, and more particularly to a three dimensional cube puzzle and a plane pattern cube puzzle comprising a number of cubes, several of which are interconnected into groups of cubes capable of being assembled into an overall cube whereby the numeral total is always the same along several columns and rows of the overall cube faces.

2. Description of the Prior Art

There have been proposed various assembling block puzzles which are disclosed in the prior art, such as in Japanese Utility Model Application Publication Nos. 67787/1982, 142593/1988, 68580/1981, 1488/1983 and 158386/1988 all of which have not been examined, and the Japanese Patent Application Publication No.104288/1989, which was finally rejected on Dec. 7, 1993.

The conventional block puzzle for assembling the desired structures are exciting, but most of them can be assembled quite easily without due consideration, and some is not always suitable for the children from the educational point of view.

SUMMARY OF THE INVENTION

A principal object of this invention is to provide a new cube puzzle for assembling the desired three dimensional structures which excites a player's interest greatly and furthers the development of the player's imagination.

Another object of this invention is to provide a new cube puzzle for assembling the desired structures which can be played by those including a child, a grandfather and a grandmother because the components are made of closed cell polyethylene resin that is light in weight.

Another object of this invention is to provide a new cube puzzle whereby a desired three dimensional structure can be erected.

Another object of this invention is to provide a new cube puzzle whereby the desired plane characters such as animals, bipeds or flowers can be assembled.

Another object of this invention is to provide a new cube puzzle whereby a game can be played by two or four players, allowing to assemble the desired structures, to play a booking seat game or to play a changing game of the assembled patterns.

Another object of this invention is to provide a new cube puzzle whereby a game can be played joyously by a plurality of players by selecting the cube puzzles.

Another object of this invention is to provide a new cube puzzle with which a player can play with the difficulty of a game by changing a number of the unit cubes to be assembled.

A still another object of this invention is to provide a new cube puzzle whereby an overall assembled cube puzzle cannot be seen through readily by the other players.

A further object of this invention is to provide a new cube puzzle which can be used as a toy for use as a learning aid of carrying out simple arithmetic exercises.

Other objects, advantages and novel features of this invention will become apparent from the following detailed description when considered in conjunction with the accompanying drawings.

BRIEF SUMMARY OF THE INVENTION

A cube puzzle for assembling the desired structure of this invention comprises a large number of disconnected cube blocks of different configurations, each of cube blocks being different from each other, and the first group including a plurality of large different cube blocks and the second group including a small number of small different cube blocks, and forming an overall cube when assembled in a final or particular configurations, which is characterized in that the large different cube blocks can be separated again into a number of cube blocks which can be expressed by a formula of $n^3=6^3$, the large different cube blocks including varieties of cube blocks, each cube block having its one face being integrally secured to an adjacent one of the adjacent cube blocks on planes of the number n, the small different cube blocks, each cube block having its one face being integrally secured to an adjacent one of the adjacent cube blocks of the number less than the number n, and the large different cube blocks and the small different cube blocks being capable of either separated or assembled again to restore its original configurations.

Another essential feature of a cube puzzle of this invention is characterized in that the number n of the cube blocks are six.

Still another essential feature of a cube puzzle of this invention is characterized in that a space between the opposed faces of a regular square of a large cube block is preferably, equally and closely divided into the equal parts expressed by a symbol n, and the square plane thus obtained is divided preferably into a large block.

For a more complete understanding of the above and other features and advantages of the invention, reference should be made to the following detailed description of a preferred embodiment of the invention and to the drawings.

DETAILED DESCRIPTION OF THE INVENTION

EXAMPLES

Example 1

Figure 1:
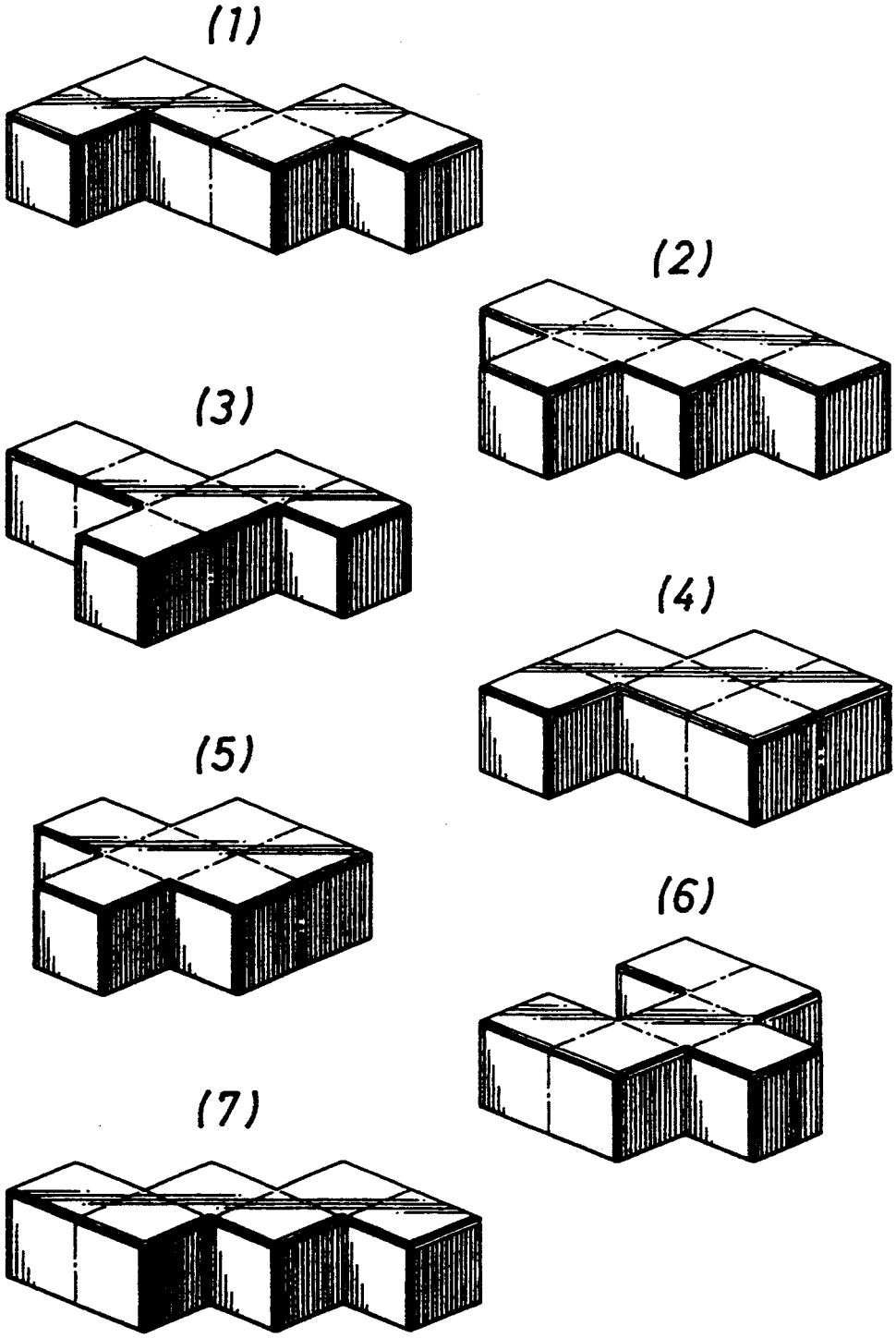
FIG. 1 is a perspective view of a plurality of large unit cubic pieces forming a large cube block.

Referring to FIG. 1 showing a plurality of large unit cubic pieces, a doubled L-shaped block piece (1), a T-shaped block piece (2) having two cubic pieces at one end portion, a T-shaped block piece (3) having a single protruding piece at one top end portion, a square block piece (4) having two protruding cubic pieces at a corner, a square block piece (5) having a single protruding cubic piece at a corner, a gate-shaped block piece (6) having a single protruding cubic block at a top middle portion, and a stepped cubic block (7) are shown.

Figure 2:
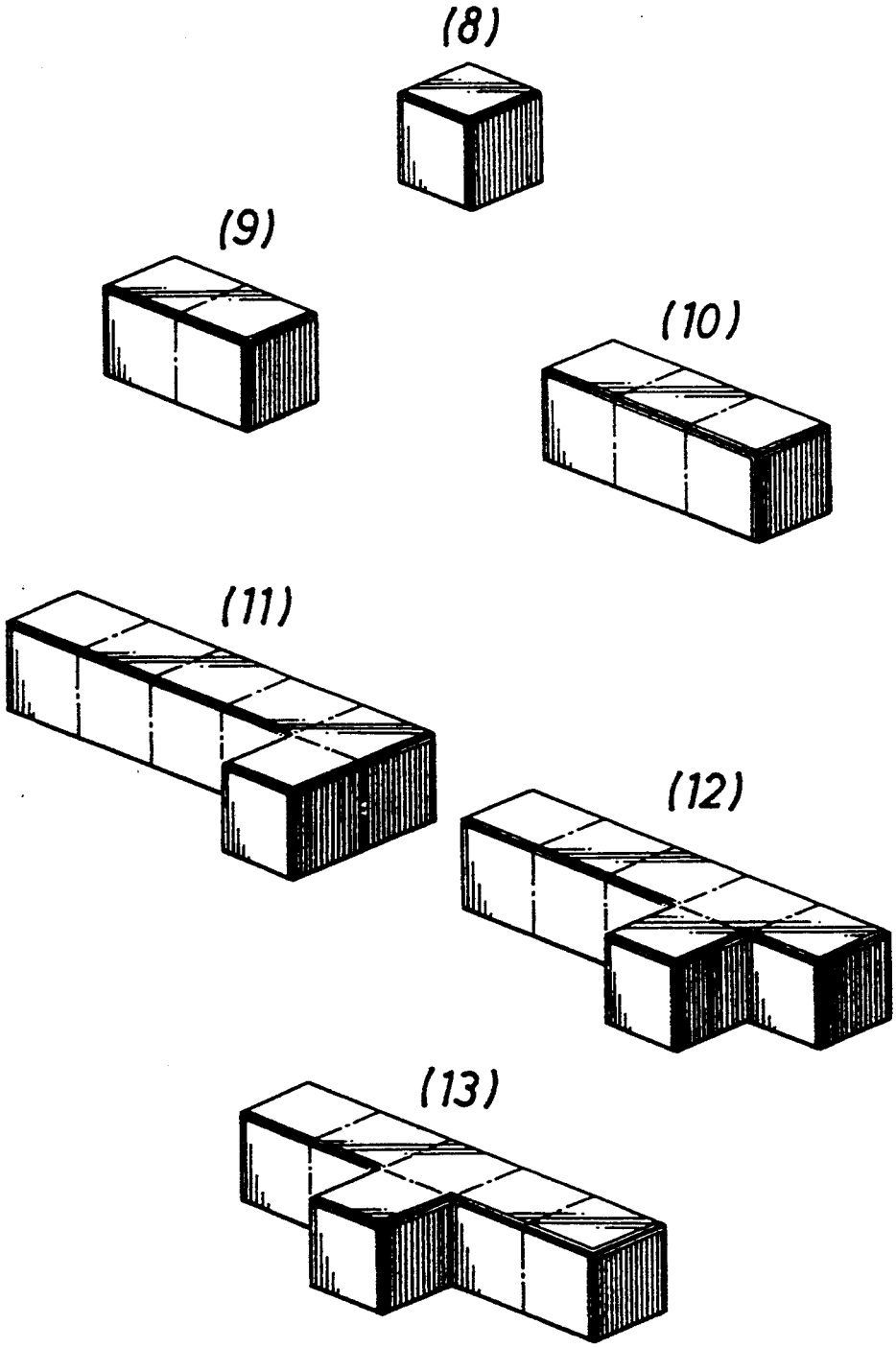
FIG. 2 is a perspective view each of three small unit cubic pieces and also three large unit cubic pieces forming a large block cube.

In FIG. 2, three small unit cubic pieces including a single cubic block (8), a doubled cubic block (9) and a three-combined cubic block (10), and three large unit cubic pieces including a five-combined large block cube (11) having a single cubic block at a top side portion, a five-combined large block cube (12) having a single cubic block at a second side portion from a top, and a five-combined large block cube (13) having a single cubic block at a middle side portion are shown.

Figure 3:
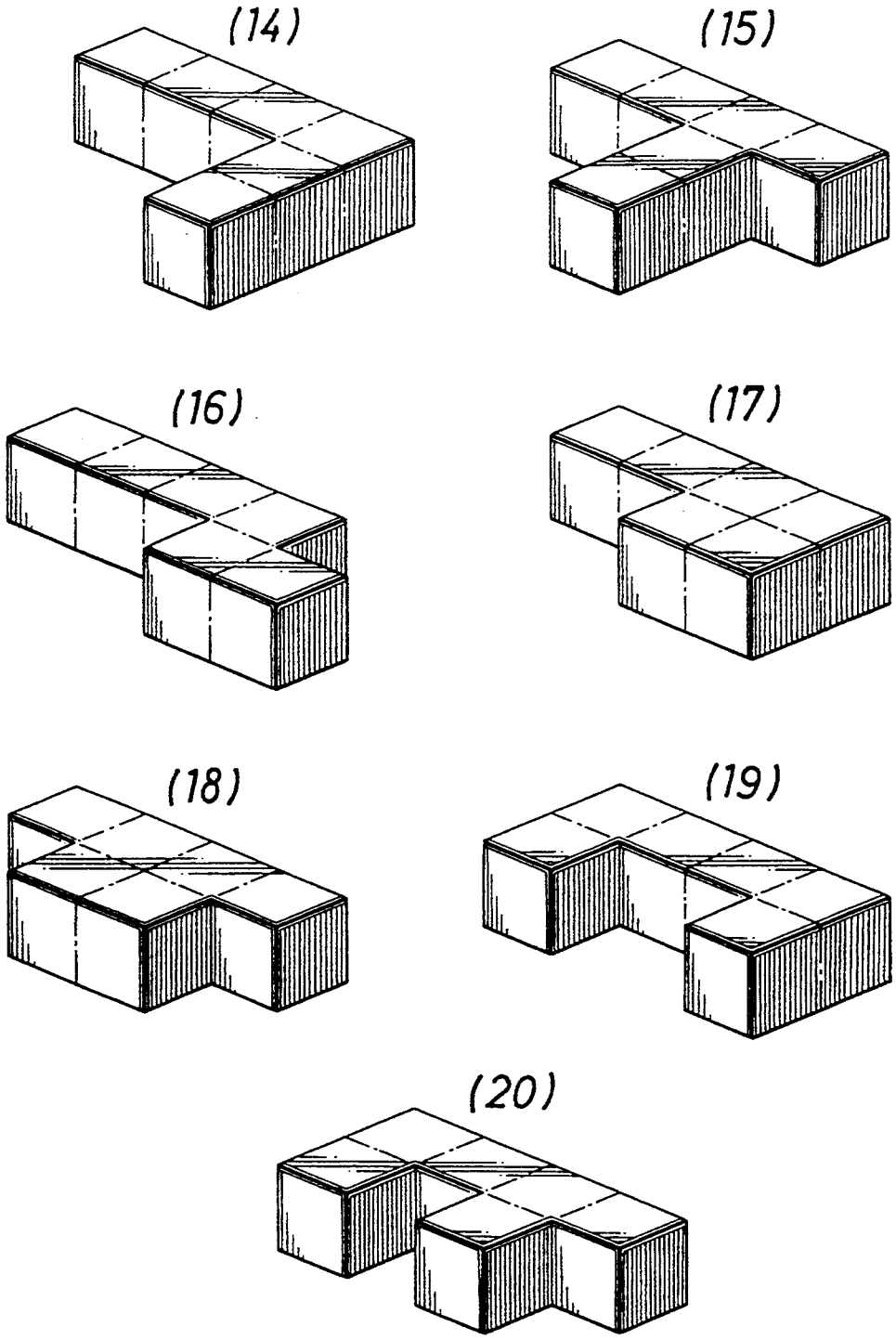
FIG. 3 is a perspective view of a plurality of large unit cubic pieces forming a large cube block.

In FIG. 3, seven large unit cubic pieces including a four-coupled large block cube (14) having a doubled protruding cubic block at a top side portion from a top, a four-coupled large block (16) having a doubled protruding cubic block at a top side portion, a four-coupled large block (17) having a doubled cubic block at a top side portion, a four-coupled large block (18) having a doubled cubic block at a middle side side portion, a gate-shaped four-coupled large block (19), and a four-coupled large block (20) having a single protruding piece at a bottom side and at a second portion from a top respectively are shown.

Figure 4:
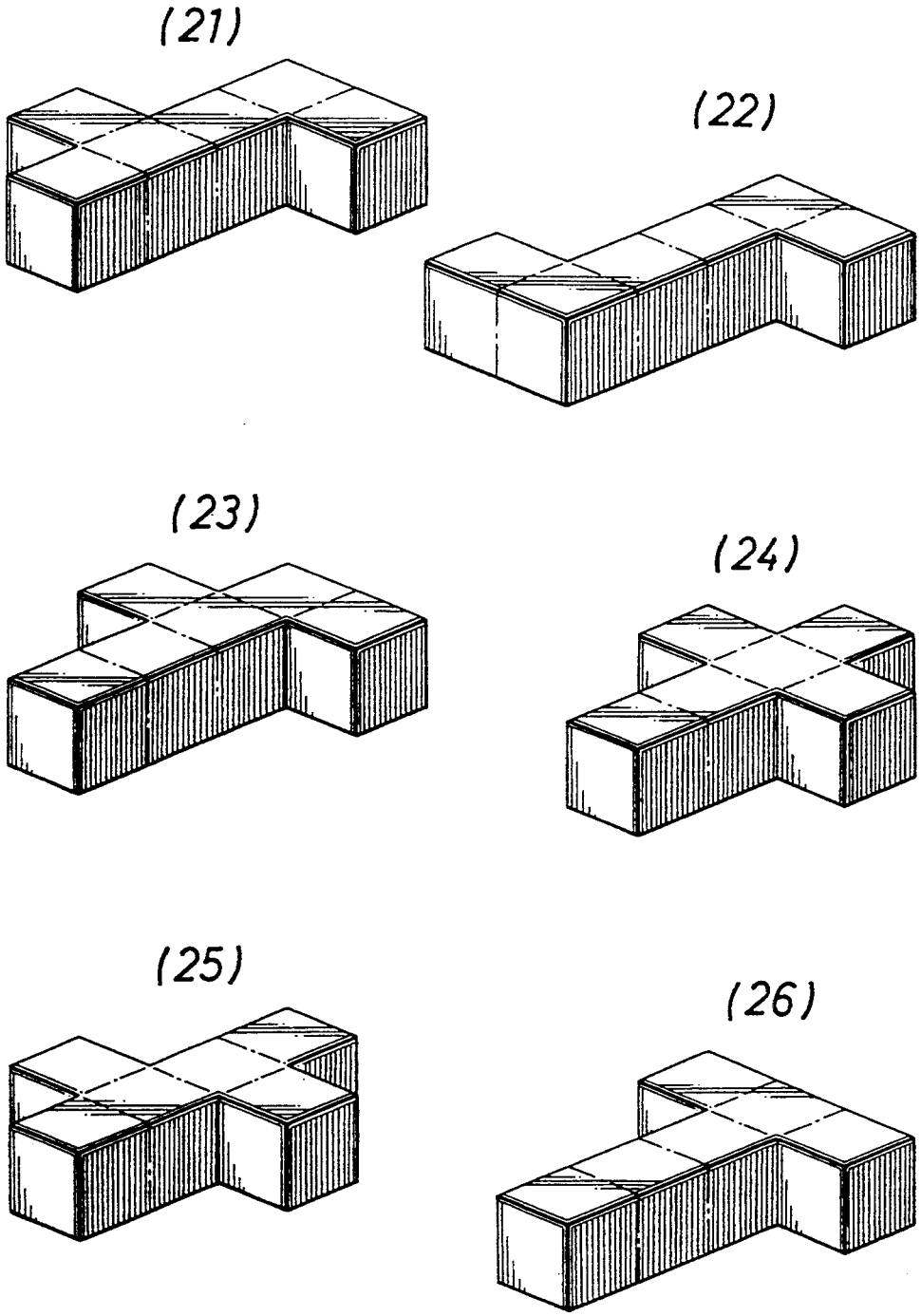
FIG. 4 is a perspective view of a plurality of large unit cubic pieces forming a large cube block.

In FIG. 4, six large unit cubic pieces including a four-coupled large block cube (21) having a single protruding piece at a top side portion and another single protruding piece at a second portion from a bottom on another side of the large block cube, a four-coupled large block cube (22) having a single protruding piece at a top side portion and another single protruding piece at a bottom side of the large block cube, a four-coupled large block cube (23) having a single protruding piece at a top side portion and another single protruding piece at a third portion from a bottom on another side of the large block cube, a crossed large block cube (24), a four-coupled large block cube (25) having a single protruding piece at a top side portion and another single protruding piece at a second side portion from a bottom of the large block cube, and a T-shaped large block cube (26) are shown.

Figure 5:
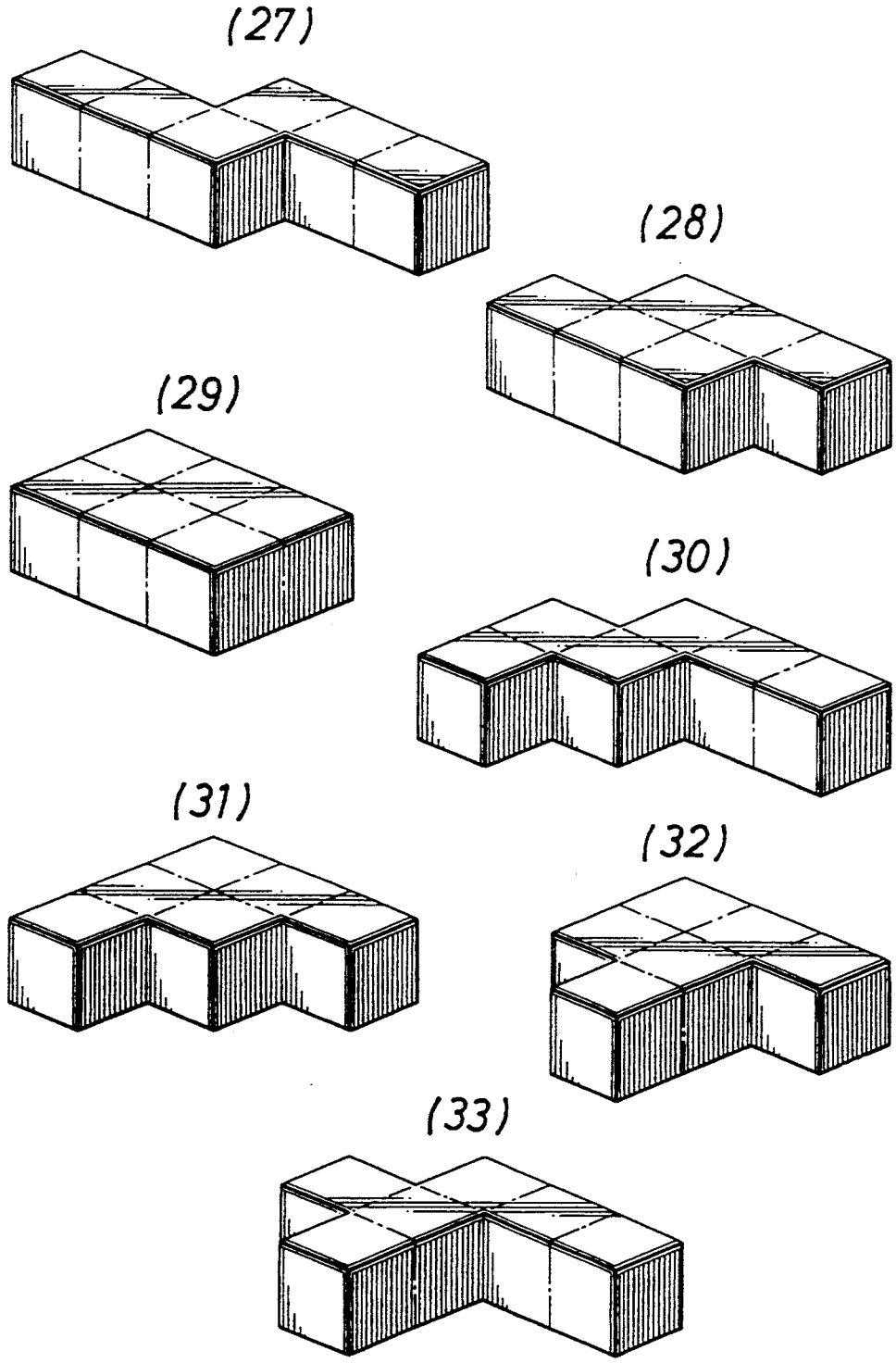
FIG. 5 is a perspective view of a plurality of unit cubic pieces forming a large block cube.

In FIG. 5, seven large unit cubic pieces including a three coupled large block cube (27) having another three coupled large block cube integrally standing on one different mate of a side thereof, a three-coupled large block cube (28) having another three coupled large block cube integrally standing on two different mates of a side thereof, a rectangular large block cube (29) a three-coupled large block cube (30) having a protruding L-shaped piece at a bottom side portion thereof, an L-large block cube (31) having a single piece at a corner thereof, a three-combined large block cube (32) having a protruding L-shaped piece integrally provided at two block pieces thereof, and a three-coupled large block cube (33) having a protruding L-shaped piece integrally provided at one block piece thereof are shown.

Figure 6:
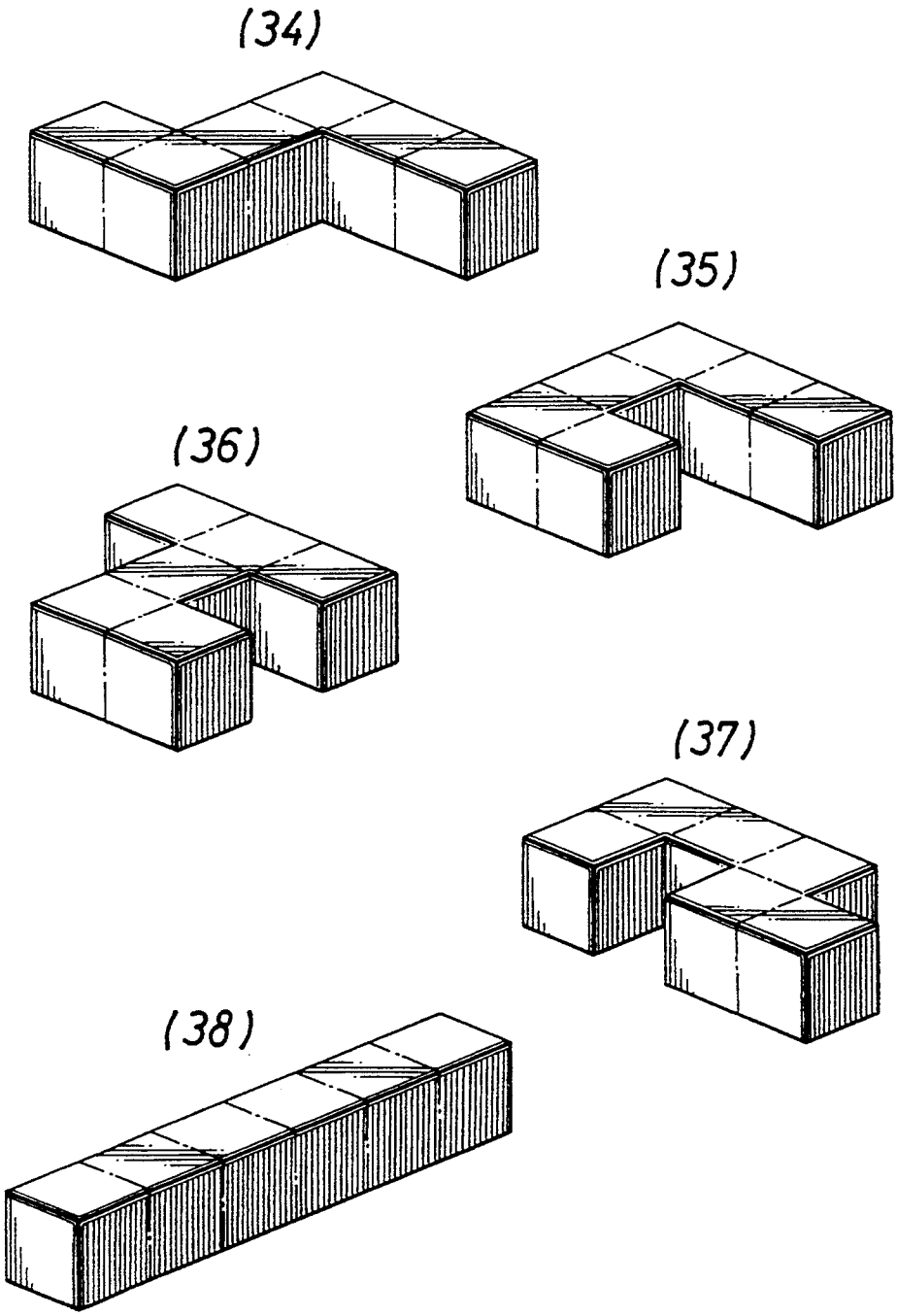
FIG. 6 is a perspective view of a plurality of unit cubic pieces forming a large block cube.

In FIG. 6, five large unit cubic pieces including a three-coupled L-shaped large block cube (34) having a single protruding piece at a top outer side portion thereof, an L-shaped large block cube (35) having a single protruding piece at a top inner side portion thereof, a three-combined gate shaped large block cube (37) having a single protruding piece at a top outer side portion, and a six-coupled straight large block cube (38) are shown.

Figure 16:
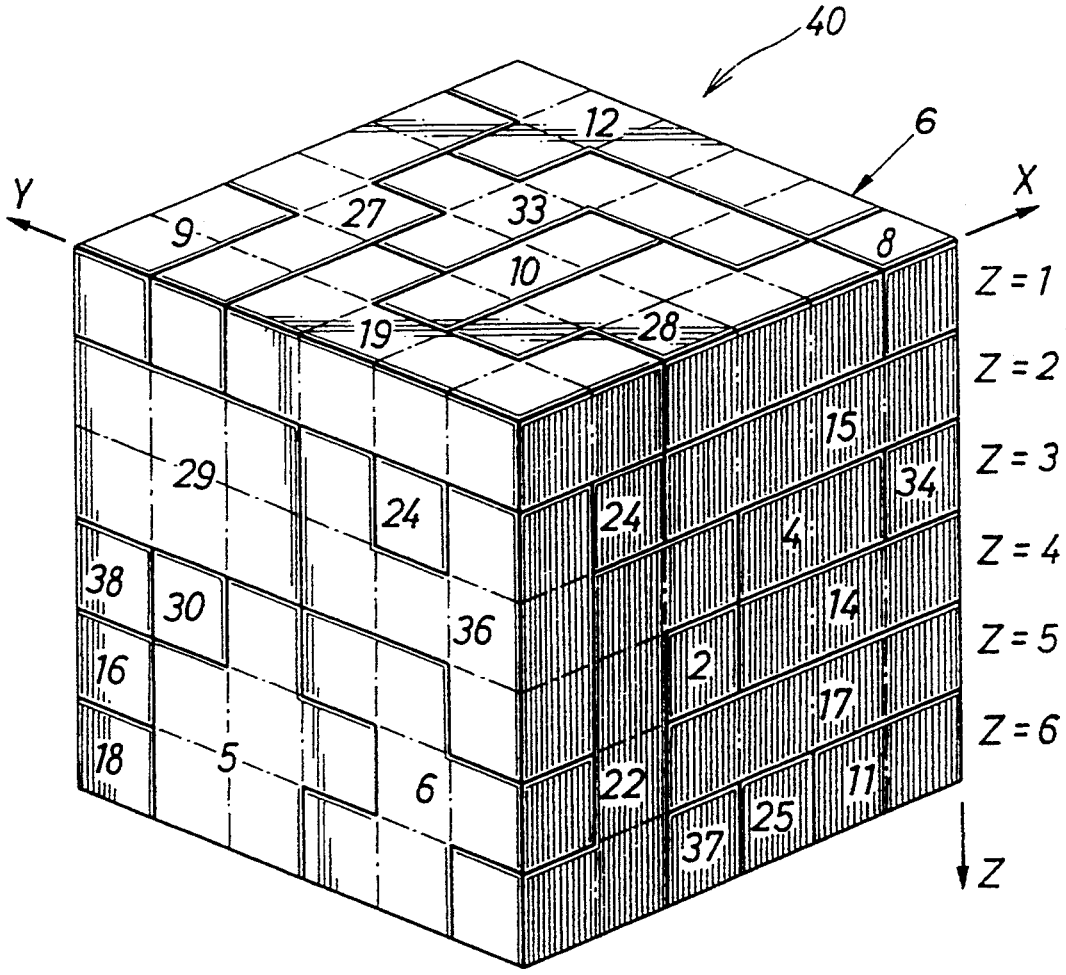
FIG. 16 is a perspective view of a completed block cube.
Figure 17:
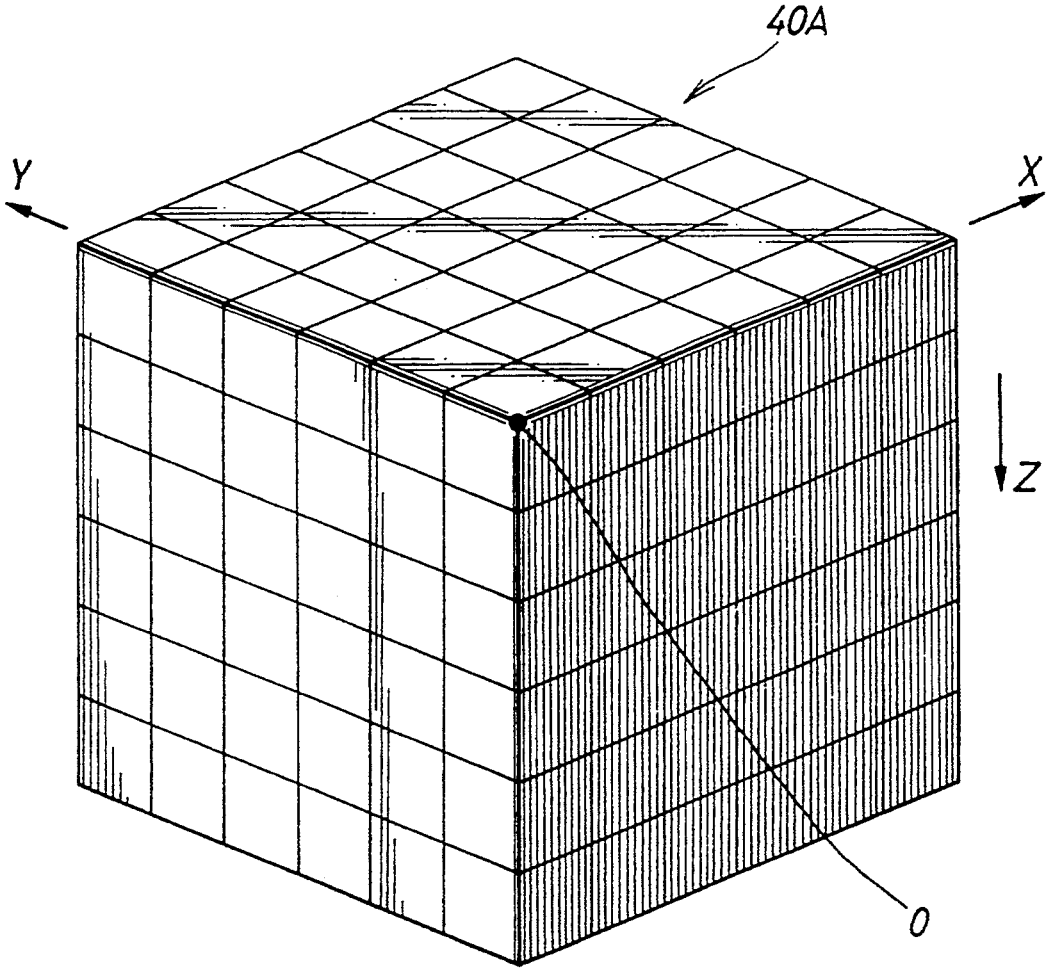
FIG. 17 is a perspective view of another completed block cube.
Figure 18A:
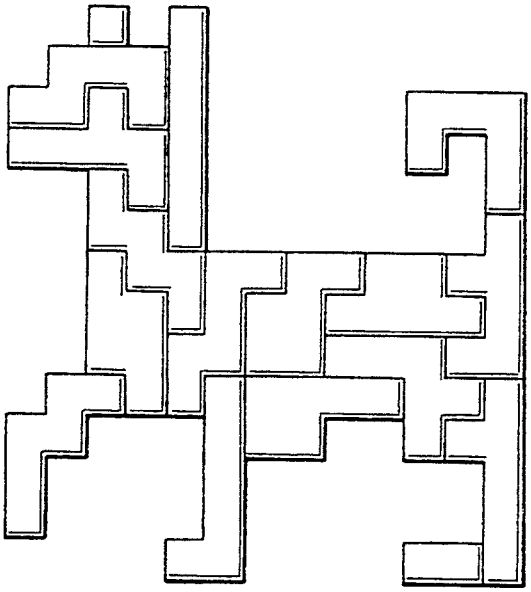
FIG. 18 is a perspective view of a plurality of assembled animals and a building.
Figure 18B:
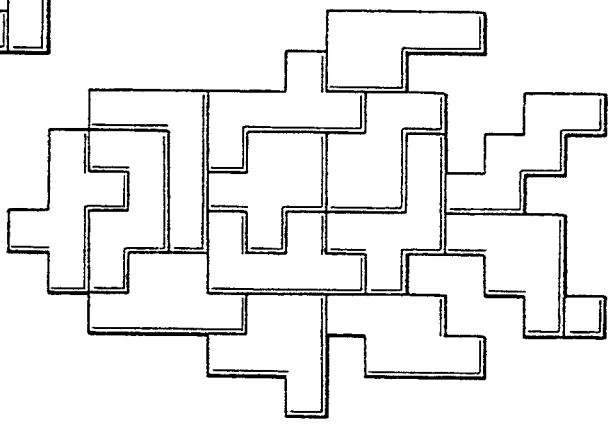
Figure 18C:
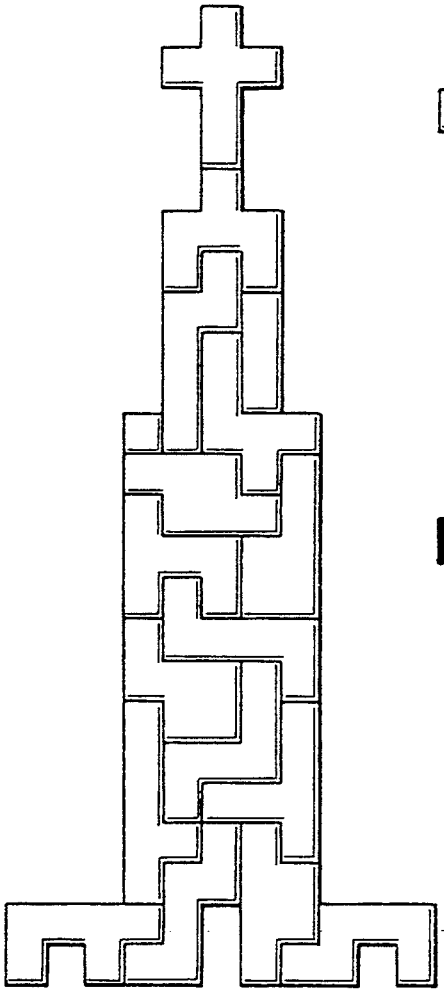
Figure 19A:
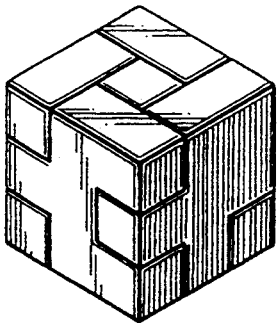
FIG. 19 is a perspective view of a plurality of assembled cube puzzles.
Figure 19B:
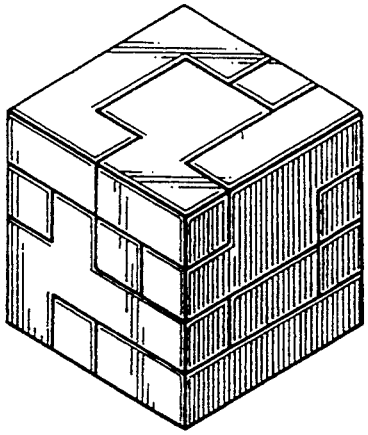
Figure 19C:
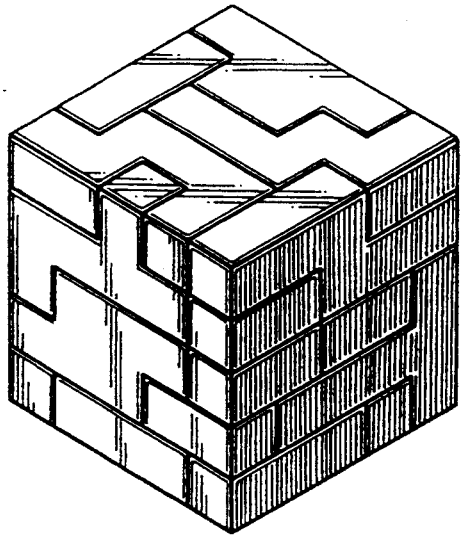
Figure 19D:
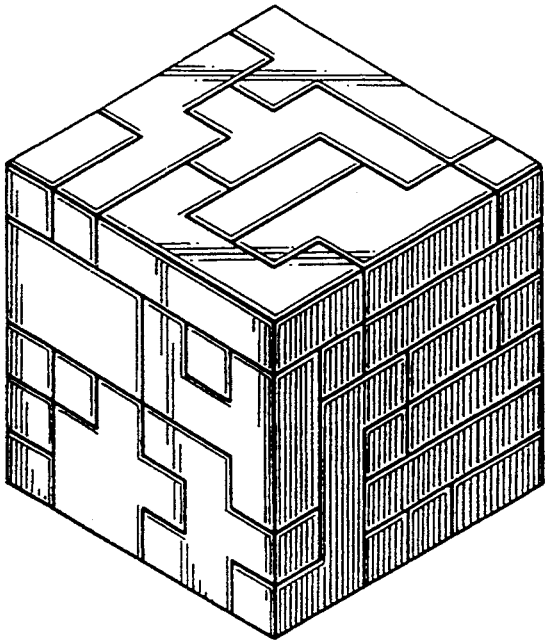
Figure 20A:
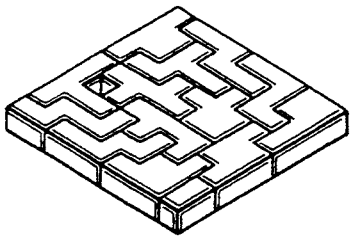
FIG. 20 is a perspective view showing an order of assembling a building.
Figure 20B:
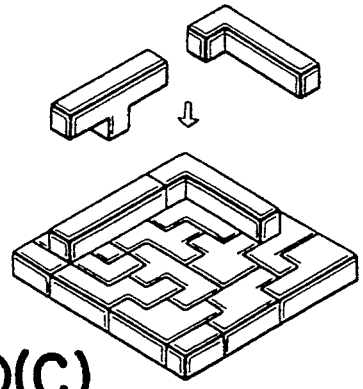
Figure 20C:
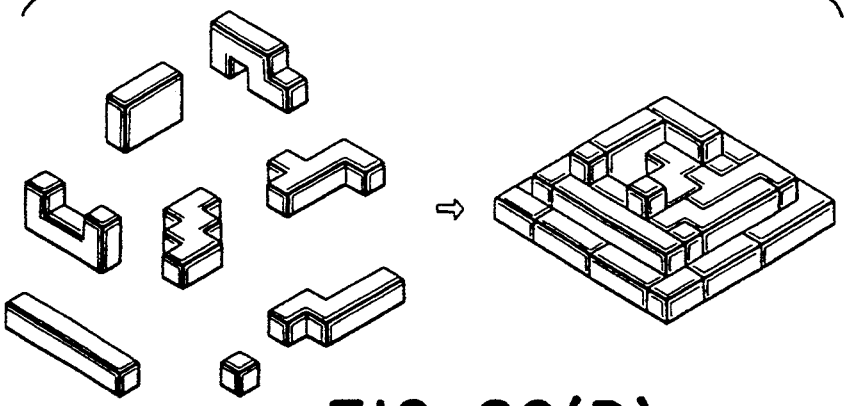
Figure 20D:
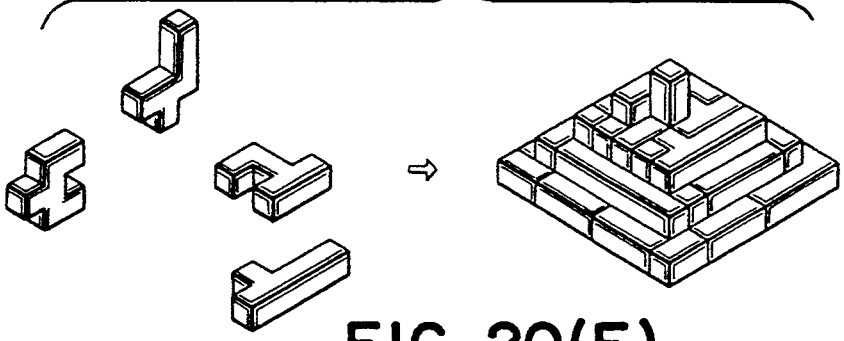
Figure 20E:
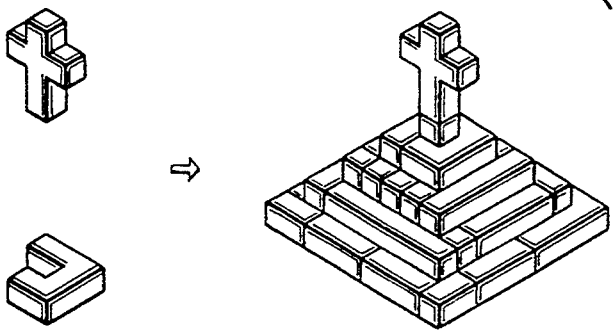
Figure 21:
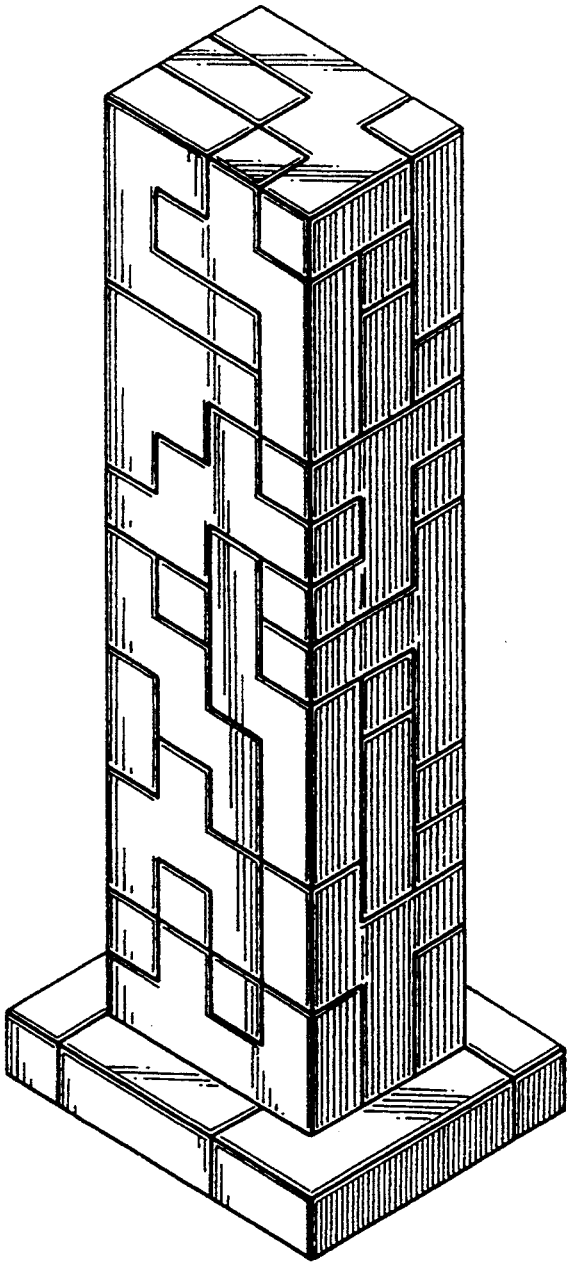
FIG. 21 is a perspective view of an assembled tower.

FIG. 17 is a perspective view of the assembled cube block 40 which is the same as the one being assembled as shown in FIG. 16.

As shown in the drawing, the sides X, Y and Z (or integer n) are the right angle coordinates extending from the origin O of the assembled cube block 40 which include 6 unit cube blocks.

The unit cube block has six faces (1, 1, 1) and the integral or assembled cube blocks are expressed as the integers 2, 3, 4, 5 and 6 respectively. As illustrated in the drawings, n=6, and the assembled cube block 40A can be divided into the numbers which can be expressed by the following formula of $$n^3=6^3.$$

Figure 14:
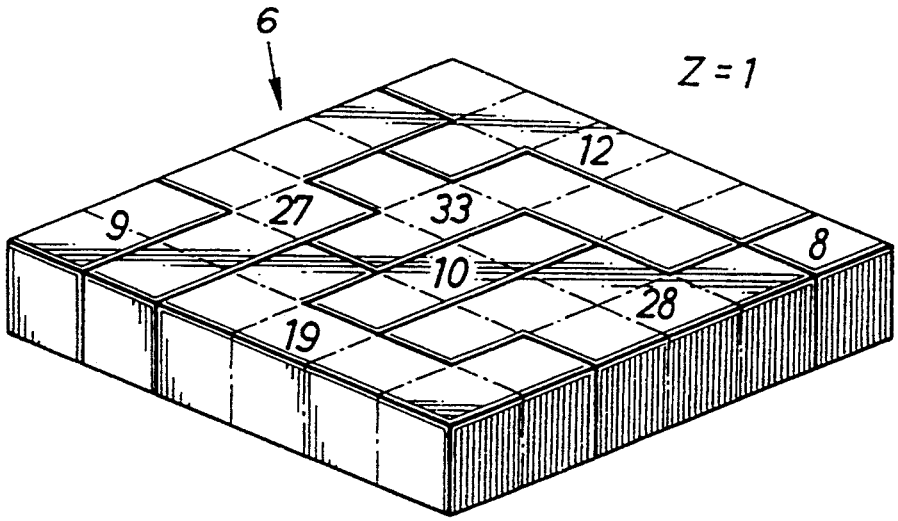
FIG. 14 is a perspective view of another partially assembled plane.

As particularly shown in FIG. 14, a large cube block including five different unit cube blocks 12, 19, 27, 28 and 33, and a small cube block including three unit cube blocks such as a single unit cube block 8, two unit cube blocks 9 and three straight unit cube blocks 10, which are integrally assembled to form a plane 6 or a square layer Z=1.

Figure 13:
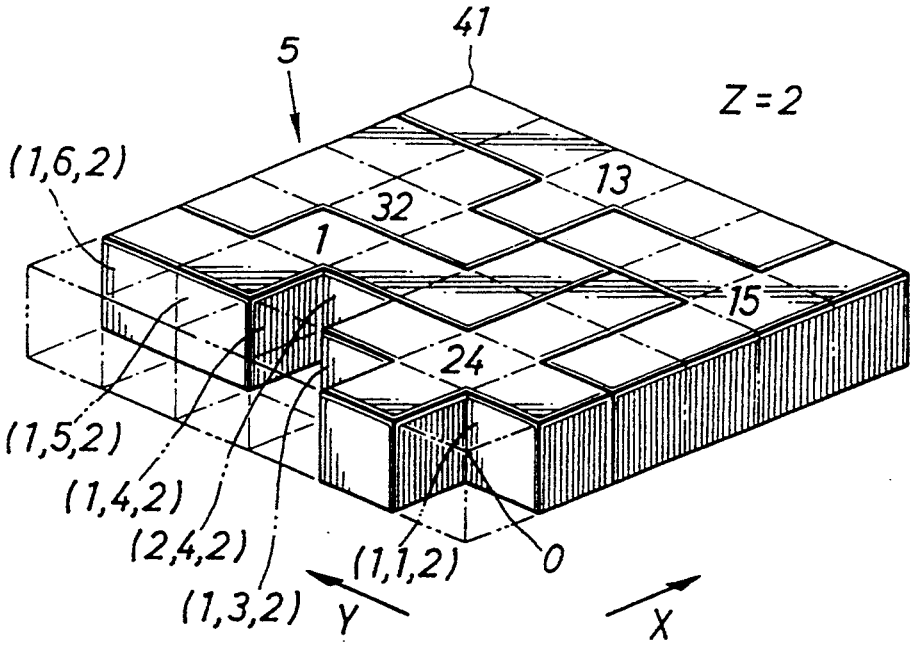
FIG. 13 is a perspective view of another partially assembled plane.

As shown in FIG. 13, a plane 5 or a square layer Z=2 comprises a large cube block including five different unit cube blocks 1, 13, 15, 24 and 32. From the side X of the square layer Z are taken out the unit cube blocks to form cubic spaces (1,6,2), (1,5,2), (1,4,2), (1,3,2), (1,1,2) and (2,4,2).

Figure 10:
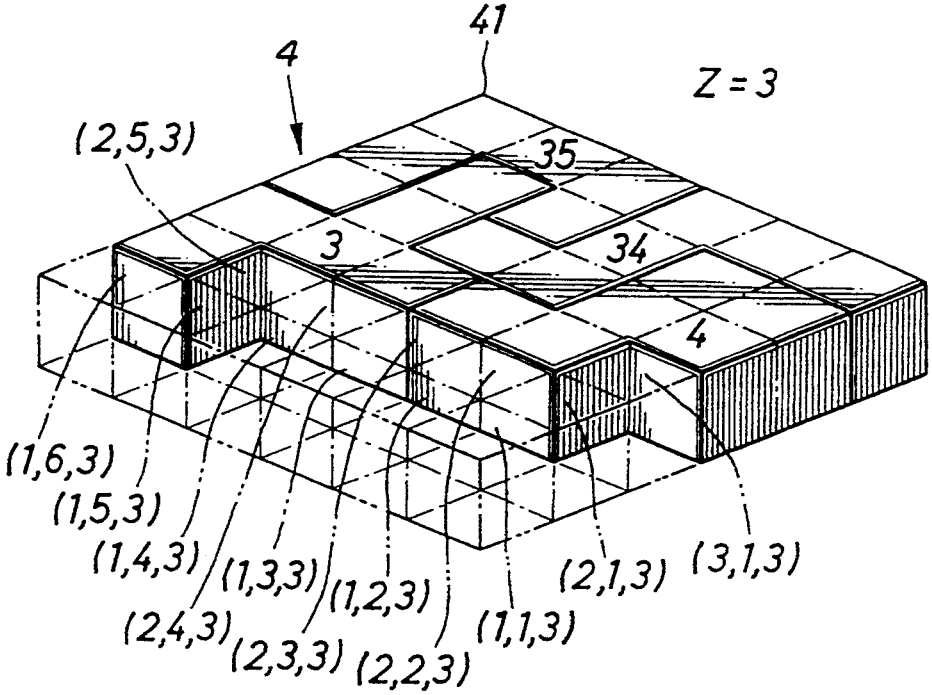
FIG. 10 is a perspective view of another partially assembled plane.

Referring to FIG. 10, a plane Z=3 comprises a large cube block (4) including four different unit cube blocks 3, 4, 34 and 35, from the sides X=1, X=2 and Y=1 of which are taken out the cube blocks so as to form cubic spaces (X, Y, 3).

Figure 9:
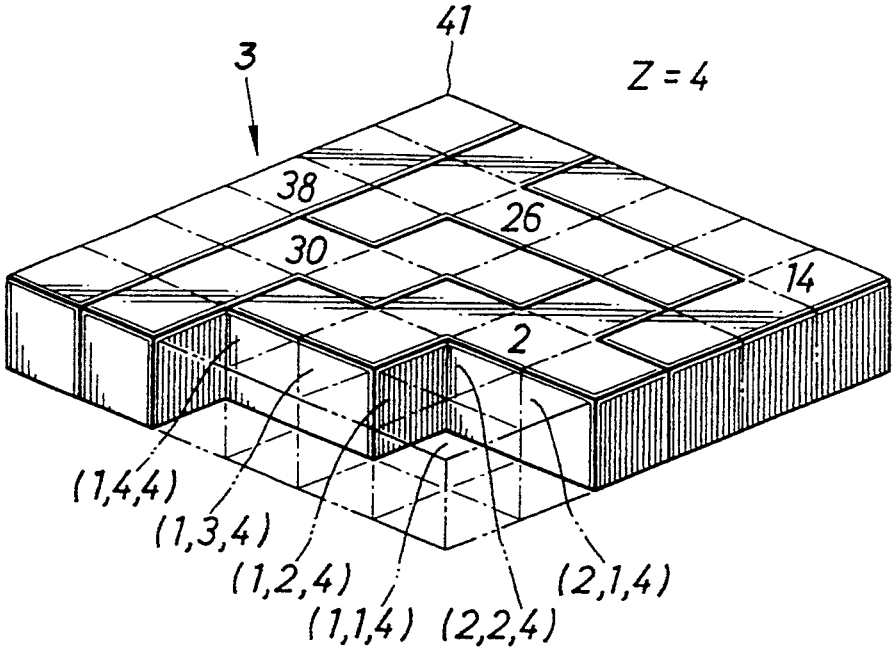
FIG. 9 is a perspective view of another partially assembled plane.

Referring to FIG. 9, a plane Z=4 comprises a large cube block (3) including five different unit cube blocks 2, 14, 26, 30 and 38, from the sides X=1, X=2 and Y=1 of which are taken out the cube blocks so as to form cubic spaces (X, Y, 4).

Figure 8:
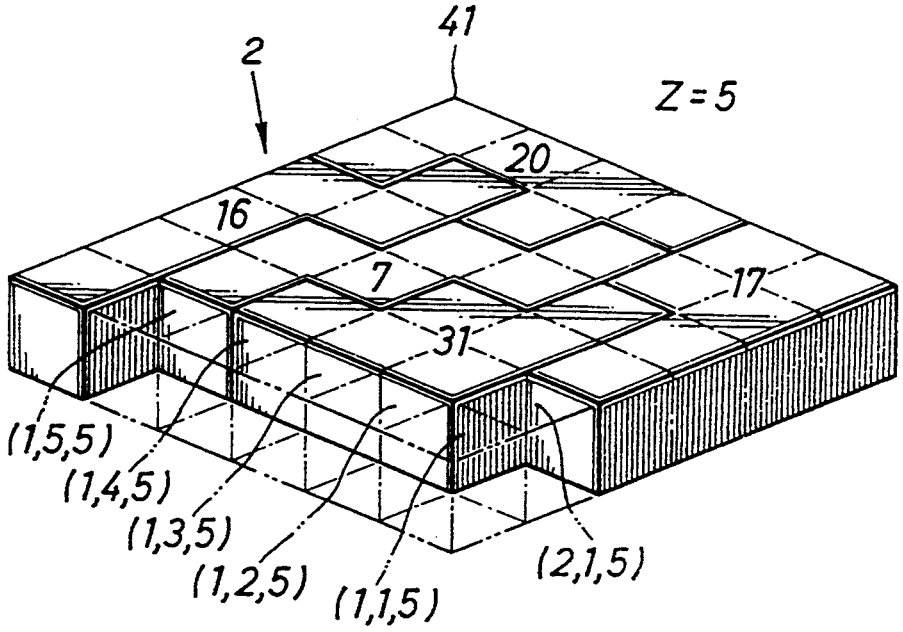
FIG. 8 is a perspective view of another partially assembled plane.

Referring to FIG. 8, a plane Z=5 comprises a large cube block (2) including five different unit cube blocks 7, 16, 17, 20 and 31, from the sides X=1 and Y=1 of which are taken out the cube blocks so as to form cubic spaces (X, Y, 5).

Figure 7:
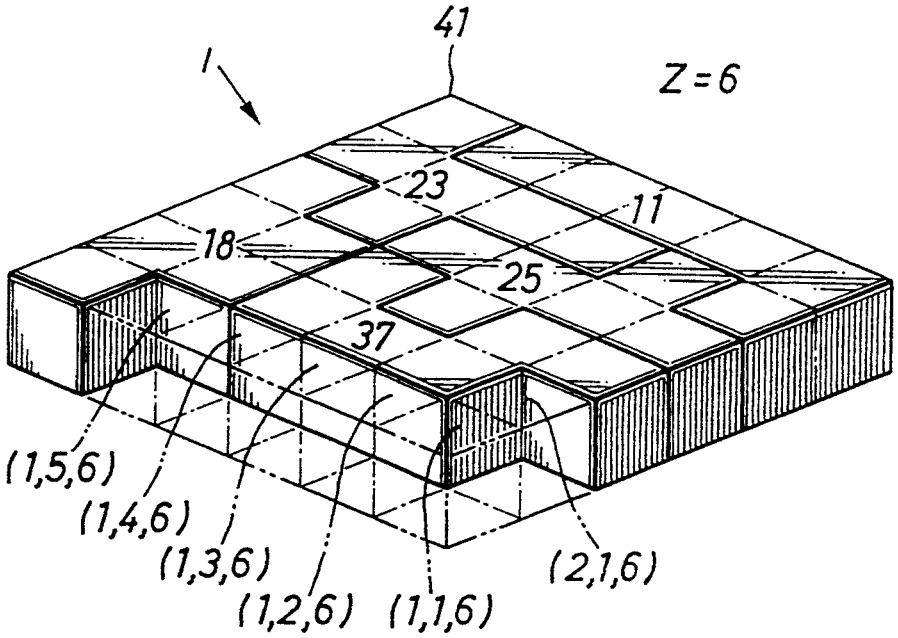
FIG. 7 is a perspective view of a partially assembled plane.

Referring to FIG. 7, a plane Z=5 comprises a large cube block (1) including five different unit cube blocks 11, 18, 23, 25 and 37, from the sides X=1 and Y=1 of which are taken out the cube blocks so as to form cubic spaces (X, Y, 6).

Figure 11:
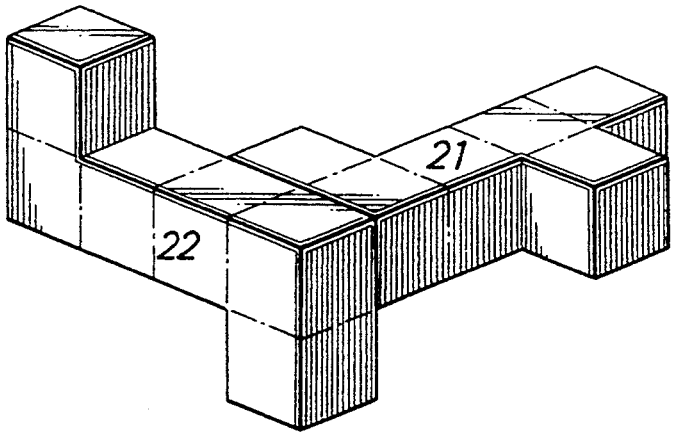
FIG. 11 is a perspective view of another partially assembled plane.
Figure 12:
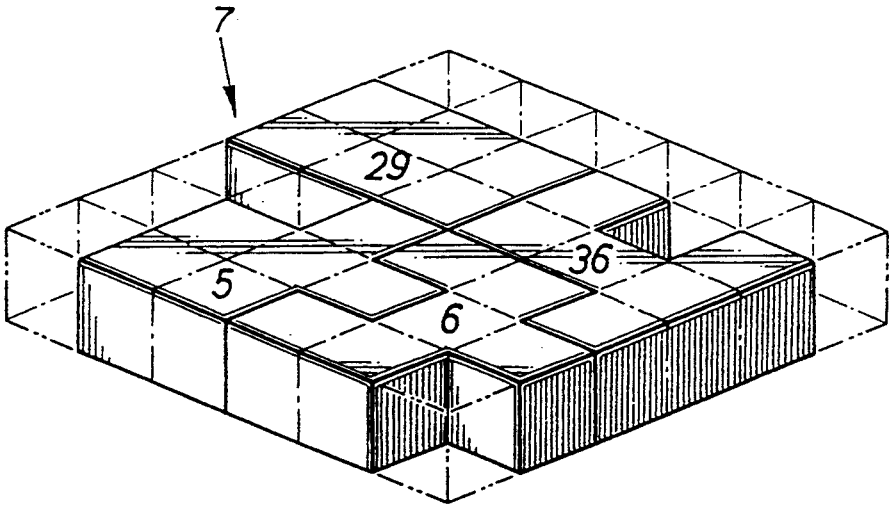
FIG. 12 is a perspective view of another partially assembled plane.

The cubic spaces thus formed in the assembled cube block 40 can be made up with the large cube blocks decomposed vertically as shown in FIGS. 11 and 12.

Figure 15:
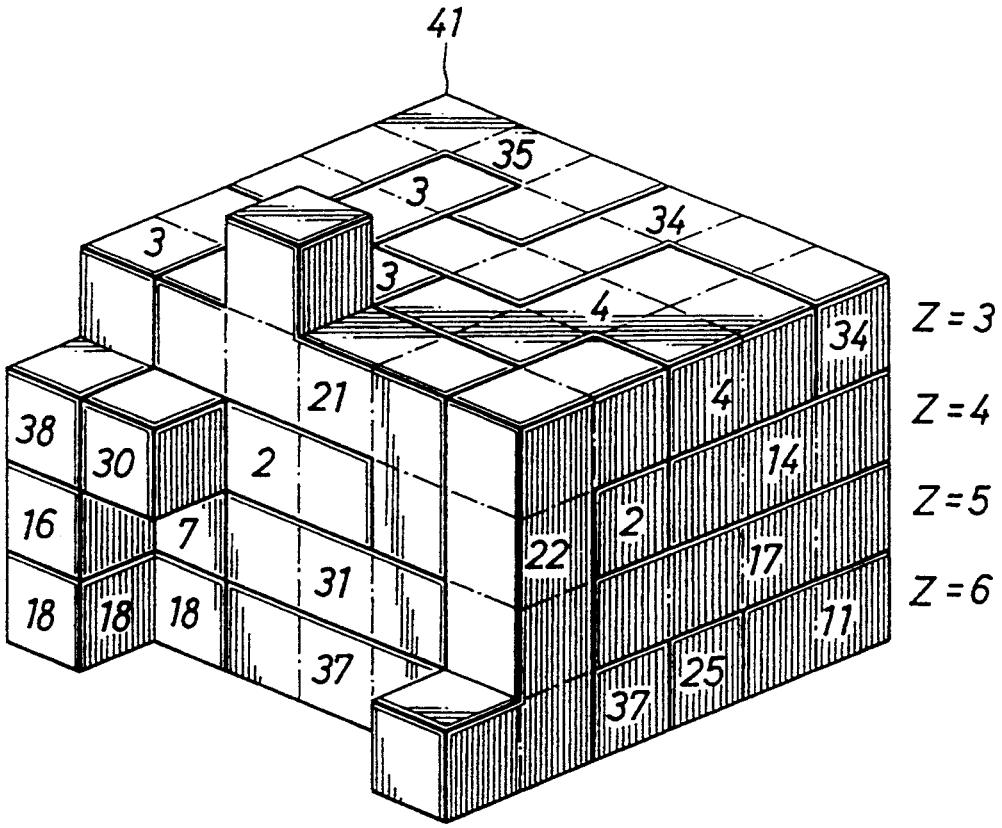
FIG. 15 is a perspective view of an assembled block cube just around its completion.

As shown in FIGS. 11 and 15, a right portion of the large cube block 21 coupled with the large cube block 22 appears at an upper portion in FIG. 15, a right upper portion of FIG. 11 appears at a left portion of FIG. 15, a middle lower portion appears at an upper portion, and a left portion appears at a middle lower portion respectively.

It is considered that the unit cubic space (2, 4, 2) at a face of Z=2 (shown in FIG. 13), the unit cubic spaces (2, 1, 3), (2, 2, 3), (2, 3, 3), (2, 4, 3), (2, 5, 3) and (3, 1, 3) at a face of Z=3 (shown in FIG. 10), the unit cubic spaces (2, 1, 4) and (2, 2, 4) at a face of Z=4 (shown in FIG. 9), the unit cubic space (2, 1, 5) at a face of Z=5 (shown in FIG. 8) and the unit cubic spaces (1, 1, 6) and (2, 1, 6) at a face of Z=6 (shown in FIG. 7) are taken out respectively.

It should be remembered that as shown in FIG. 12, a right upper portion of the partially assembled plane 7 appears at an upper portion in FIG. 16, a left lower portion appears at a lower portion, a left portion appears at a left portion, and a right portion appears at a right portion respectively.

One can understand from FIG. 16 that the large cube blocks 5, 6, 29 and 36 can be decomposed from the assembled overall cube 40.

Referring to FIG. 13, it can be easily understood that the large cube blocks 5, 6, 29 and 36 can be taken out from the unit cubic spaces (1, 1, 1), (1, 3, 2), (1, 4, 2), (1, 5, 2) and (1, 6, 2) at a face of Z=2 (shown in FIG. 13), from the unit cubic spaces (1, 1, 3), (1, 2, 3), (1, 3, 3), (1, 4, 3), (1, 5, 3) and (1, 6, 3) at a face of Z=3 (shown in FIG. 10), from the unit cubic spaces (1, 1, 4), (1, 2, 4), (1, S, 4) and (1, 4, 4) at a face of Z=4 (shown in FIG. 9), from the unit cubic spaces (1, 1, 5), (1, 2, 5), (1, 3, 5), (1, 4, 5) and (1, 5, 5) at a face of Z=5 (shown in FIG. 8) and from the unit cubic spaces (1, 2, 6), (1, 3, 6), (1, 4, 6) and (1, 5, 6) at a face of Z=6 (shown in FIG. 7).

The large cube blocks 1–7 and 11–38 and the small cube blocks 8–10 thus separated are shown FIGS. 1–6.

The puzzle solver may assemble the overall cube 40 shown in FIG. 16, and any other dimensional configurations or different plane patterns by using all of the detached large and small cube blocks shown in FIGS. 1–6.

A game of this invention may be carried out for example by assembling the large cube blocks on the plane.

A partially assembled plane (1) is brought together by the large cube blocks 11, 18, 23, 25 and 37 as shown in FIG.

As shown in FIG. 8, a partially assembled plane (2) is brought together by the large cube blocks 7, 16, 17, 30 and 31, and as shown in FIG. 9, a partial plane (3) is assembled by the large cube blocks 2, 14, 26, 30 and 38.

As shown in FIG. 10, a partial plane e,crc/4/ is assembled by the large cube blocks 3, 4, 34 and 5.

As shown in FIG. 13, a partial plane (5) is assembled by the large cube blocks 1, 13, 15, 24 and 32, and as shown in FIG. 14, a partial plane (6) is assembled by the large cube blocks 12, 19, 27, 28 and 33 and by the small cube blocks 8, 9 and 10.

As shown in FIG. 15, the assembled planes (1)-(4) are stacked up from a bottom according to their orders with their upper angles 41 and adjacent sides being coincided with each other, thus assembling the overall cube 40 shown in FIG. 16 with excluding the large block cubes 21 and 22. Accordingly, the large block 21 coupled with the large block 22 shown in FIG. 15 is fitted into the cubic spaces.

Referring to FIG. 16, the partially assembled planes (4) and (5) are fitted into the partially assembled overall cube 40 with their upper angles 41 and adjacent sides being coincided with each other, then the partially assembled plane (7) is fitted into a left front portion of the partially assembled overall cube 40 without the partially assembled plane (6), which is lower with the plane of Z=1 than the overall cube 40. Finally, the partially assembled plane 6 is stacked up on a top of the partially assembled cube 40 to form the overall cube 40 shown in FIG. 16.

Even if the player looks at the large and small cube blocks shown in FIGS. 1–6, he cannot think of the partially assembled planes (1)-(6), and during his thinking of every plane at a face of Z=n, he cannot understand how to assemble the large cube blocks 21 and 22 in a different direction shown in FIG. 11.

Accordingly, when the player tries to assemble the overall cube 40 using the large and small blocks in FIGS. 1–6, he may be puzzled over how to assemble it, thus presenting him an interesting challenge and subconsiously exercising his thinking faculty.

It may be preferable that the aforementioned large and small blocks are colored as desiredly, and they are made from transparent material such as polyester resin without departing from the spirit of the invention.

It is to b understood that the above described embodiment of the invention is illustrative only and that modifications thereof may occur to those skilled in the art. Accordingly, this invention is not to be regarded as limited to the embodiment disclosed herein, but is to be limited only as defined by the appended claims.

What is claimed is:

1. A cube puzzle which comprises:

a large number of disconnected cube blocks of different configurations, each of cube blocks being different from each other, and the first group including a plurality of large different cube blocks and the second group including a small number of small different cube blocks, and forming an overall cube when assembled in a final or particular configurations, which is characterized in that the large different cube blocks can be separated again into a number of cube blocks which can be expressed by a formula of $n^3=6^3$, the large different cube blocks including varieties of cube blocks, each cube block having its one face being integrally secured to an adjacent one of the adjacent cube blocks on planes of the number n, the small different cube blocks, each cube block having its one face being integrally secured to an adjacent one of the adjacent cube blocks of the number less than the number n, and the large different cube blocks and the small different cube blocks being capable of either separated or assembled again to restore its original configurations.

2. A cube puzzle according to claim 1 which is characterized in that a number n each of side of the cube blocks is six 3. A cube puzzle according to claim 1 which is characterized in that a space between the opposed faces of a regular square of said large cube block is preferably, equally and closely divided into the equal parts expressed by a symbol n, and the square plane thus obtained is divided preferably into a large block.

4. A cube puzzle according to claim 1 which comprises:

a plurality of said large unit cubic pieces, a doubled L-shaped block piece, a T-shaped block piece having two cubic pieces at one end portion, a T-shaped block piece having a single protruding piece at one top end portion, a square block piece having two protruding cubic pieces at a corner, a square block piece having a single protruding cubic piece at a corner, a gate-shaped block piece having a single protruding cubic block at a top middle portion, and a stepped cubic block, and a plurality of small unit cubic pieces including a single cubic block, a doubled cubic block and a three-coupled cubic block, and three large unit cubic pieces including a five coupled large block cube having a single cubic block at a top side portion, a five-coupled large block cube having a single cubic block at a second side portion from a top, and a five-coupled large block cube having a single cubic block at a middle side portion.

5. A cube puzzle according to claim 1 wherein cube blocks are made of closed cell polyester resin.

* * * * *